US007477200B2

(12) United States Patent
Parsche

(10) Patent No.: US 7,477,200 B2
(45) Date of Patent: Jan. 13, 2009

(54) FOLDED-MONOPOLE WHIP ANTENNA, ASSOCIATED COMMUNICATION DEVICE AND METHOD

(75) Inventor: Francis Eugene Parsche, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 11/733,826

(22) Filed: Apr. 11, 2007

(65) Prior Publication Data

US 2008/0252535 A1 Oct. 16, 2008

(51) Int. Cl.
*H01Q 1/24* (2006.01)

(52) U.S. Cl. ..... 343/702

(58) Field of Classification Search ..... 343/702, 343/715

See application file for complete search history.

(56) References Cited

U.S. PATENT DOCUMENTS

| | | | | |
|---|---|---|---|---|
| 2,614,219 A | | 10/1952 | Cary | 250/33 |
| 2,702,345 A | | 2/1955 | Walter | 250/33 |
| 3,403,405 A | | 9/1968 | Barrar et al. | 343/745 |
| 3,508,271 A | | 4/1970 | Kuecken | 343/745 |
| 4,423,423 A | | 12/1983 | Bush | 343/803 |
| 6,046,700 A | * | 4/2000 | Kitchener et al. | 343/725 |
| 6,184,833 B1 | | 2/2001 | Tran | 343/700 |
| 6,624,795 B2 | * | 9/2003 | Boyle | 343/895 |
| 6,765,536 B2 | * | 7/2004 | Phillips et al. | 343/702 |
| 7,236,133 B2 | * | 6/2007 | Ohara | 343/702 |
| 7,358,906 B2 | * | 4/2008 | Sato et al. | 343/702 |
| 2002/0089459 A1 | * | 7/2002 | Johnson | 343/725 |

* cited by examiner

*Primary Examiner*—Tho G Phan
(74) *Attorney, Agent, or Firm*—Allen, Dyer, Doppelt, Milbrath & Gilchrist, P.A.

(57) ABSTRACT

The folded-monopole whip antenna is for a portable wireless communication device having a portable housing and wireless communication circuitry carried thereby. The antenna includes a flexible antenna element extending outwardly from the housing and having a proximal end for coupling to the wireless communication circuitry and having a distal end spaced from the proximal end. The flexible antenna element may have first and second flexible elongate legs or whips extending parallel to one another. The first flexible elongate leg may have a proximal end defining a first antenna feedpoint to be coupled to the wireless communication circuitry, and the second flexible elongate leg may have a proximal end defining a second antenna feedpoint to be coupled to the portable housing. The first and second flexible elongate legs may have distal ends electrically coupled to one another. A dielectric layer may be fastened between the first and second flexible elongate legs. The folded-monopole whip antenna may provide a tactical military antenna for manpack radio requirements, with greater gain, smaller size and reduced visability at HF and VHF frequencies. It may use capacitor only matching across broad tunable bandwidths, and an elevated feedpoint for increased efficiency and RF safety.

19 Claims, 8 Drawing Sheets

FOLDED-MONOPOLE WHIP ANTENNA, ASSOCIATED COMMUNICATION DEVICE AND METHOD

FIELD OF THE INVENTION

The present invention relates to the field of communications, and, more particularly, to antennas for mobile wireless communication and related methods.

BACKGROUND OF THE INVENTION

A monopole antenna is a type of radio antenna formed by replacing one half of a dipole antenna with a ground plane at right-angles to the remaining half. If the ground plane is large enough, the monopole becomes similar to a dipole, as if its reflection in the ground plane forms the missing half of the dipole. Examples of monopole antennas include the whip antenna and the radio mast when isolated from the ground and bottom-fed.

The whip antenna is often a flexible springy wire mounted, usually vertically, with one end adjacent to a ground plane. A whip antenna can be a half element antenna that can be used with an unbalanced feed line such as coaxial cable, or attached directly to a wireless transmitter, receiver, or transceiver, in which case the radio case becomes the other dipole half element. The whip may actually form an asymmetric dipole rather than a ground-plane antenna. The short, flexible "rubber duck" antennas found on handheld two-way radios and cell phones may be examples of whip antennas, as are the long, flexible, stainless-steel antennas used in Citizens Band mobile installations. Some portable whip antennas can be telescoped down to a length of only few inches for transport and storage, and extended to several feet for operation.

Assets of the whip antenna include electrical and mechanical simplicity. Little or no installation is necessary. But, because many whip antennas are electrically small or operated with a poor electrical ground system, they can be inefficient.

In high-powered or long-range wireless communications, substantial outdoor antennas, used with well-engineered feed systems, work much better than whip antennas. In addition, such a transmitting antenna may be placed at a distance from humans and electronic equipment. A whip antenna structure may need to incorporate a transmission line.

The rigors of the military whip antenna environment cannot be understated. They should be capable of repeated and continuous flexing, as a result of soldier movement, without any damage to the antenna. In addition, they should be capable of withstanding the action of extensive exposure to sand, sea water and salt, ice, snow and the like.

The whip antenna approximates a 1 dimensional or line structure, taking up a minimum of volume. It is often the most operationally suitable antenna for lower frequencies, offering a good trade between radiation efficiency and physical size. Military manpack antennas are often used in combat areas where the requirement for low visibility is most important.

Since manpack battery power is small, antenna radiation efficiency must be high. The operator may stand, walk, or lie on the ground, which imposes demanding requirements on the antenna matching system. For instance, handset cord position varies antenna electrical structure, and an officer may even use a second handset. Proximity effects may occur as the soil and the radio operator both interact with the antenna near electric fields. Depending on tactical needs, manpack whip antennas may be bent or tucked into clothing, such as load carrying equipment (LCE/ALICE/MOLLE). Military radio men ("oscars") have been creative in concealing the antenna whip, e.g. with some having even worn their radios upside down, inverting the antenna.

In United States military communications, the AT-272A "Blade" and AT-892/PRL-24 3-foot tape "Bush-Whip" are flexible whip antennas for manpack radios. Their mechanical construction may be familiar from measuring tapes, as they are made from tempered steel strips. Electrically they are monopole antennas but mechanically they are leaf springs. Leaf spring monopole antennas like the AT-272A and the AT-892/PRL-24 are rugged and durable in military service.

A limitation arises however when these whip or monopole antennas become electrically short: inductive loading is required and the associated loading "coil" can have resistive losses. In fact, if made short enough, all inductor loaded monopole antennas will become inefficient and have low gain. Larger and larger loading inductance is required with decreasing whip lengths, causing decreasing efficiency.

There is however a way to minimize loading losses in short monopoles: capacitive loading. This is because capacitors are generally more efficient than inductors. In current physics, nature provides excellent insulators but only fair conductors at room temperature. This situation favors capacitor efficiency over inductor efficiency. For instance, the "Q" value of available inductors may be only 100 at HF and but over 3000 for capacitors.

For capacitive loading to be used, the loaded antenna should provide an inductive driving point impedance, as the loading reactor must afford a conjugate match. Inductive driving impedances occur in small loop antennas, but loops can be physically unwieldy for portable radio communications. A whip antenna with inductive driving point impedance is needed.

U.S. Pat. No. 2,702,345, to Walter and entitled "Radiation and Interception of Electromagnetic Waves", proposes inset or shunt feeds to accomplish linear antennas from various tower structures. There remains a need for military antennas mating to modern antenna couplers. Also, U.S. Pat. No. 3,403,405, to Barrar and entitled "Telescoping Folded Monopole With Capacitance At The Input" describes a mechanically reconfigurable antenna resonated with a single loading capacitor. Tuning is accomplished by adjusting antenna length, and a more durable construction could be desirable for military needs.

Prior art whip antennas include electrically short monopoles, operated by forced resonance, and mechanical tuning. They can include inductive loading with lossy loading coils, and radiation efficiency of less than 5%. A durable whip antenna for a radio, e.g. a manpack radio such as the Falcon Manpack Radio from Harris Corporation, is needed with a smaller size, higher gain and greater range.

SUMMARY OF THE INVENTION

In view of the foregoing background, it is therefore an object of the present invention to provide a wireless communication device with a smaller whip antenna having increased gain and range.

This and other objects, features, and advantages in accordance with the present invention are provided by a portable wireless communication device including a portable housing, wireless communication circuitry carried by the housing, and a flexible antenna extending outwardly from the housing and having a proximal end coupled to the wireless communication circuitry and having a distal end spaced from the proximal end. The flexible antenna may have first and second flexible elongate legs or whips extending parallel to one another. The first flexible elongate leg may have a proximal end defining a first antenna feedpoint coupled to the wireless communication circuitry, and the second flexible elongate leg may have a proximal end defining a second antenna feedpoint coupled to the portable housing. The first and second flexible elongate legs may have distal ends electrically coupled to one another.

The portable housing may include one or more shoulder straps attached thereto. An antenna feed structure may connect the first antenna feedpoint to the wireless communication circuitry, and may connect the second antenna feedpoint to the portable housing. The first and second flexible elongate legs may comprise respective first and second spring steel strips, which may be copper plated. The first and second steel spring strips may have a width in a range of 0.5-1.0 inches, and may have a length in a range of four to six feet.

The flexible antenna may further include a dielectric layer between the first and second flexible elongate legs. Such a dielectric layer may comprise a liquid crystal polymer (LCP) material and/or a polytetrafluoroethylene (PTFE) material. Furthermore, the flexible antenna may further include one or more dielectric fasteners, e.g. rivets, connecting the dielectric layer and the first and second flexible elongate legs. Each of the first and second flexible elongate legs may have an arcuate cross section to urge the flexible antenna into a fully extended and straight position.

Another aspect of the present invention is directed to a folded-monopole whip antenna for a portable wireless communication device having a portable housing and wireless communication circuitry carried thereby. The antenna includes a flexible antenna element extending outwardly from the housing and having a proximal end for coupling to the wireless communication circuitry and having a distal end spaced from the proximal end. The flexible antenna element may have first and second flexible elongate whips extending parallel to one another. The first flexible elongate whip may have a proximal end defining a first antenna feedpoint to be coupled to the wireless communication circuitry, and the second flexible elongate whip may have a proximal end defining a second antenna feedpoint to be coupled to the portable housing. The first and second flexible elongate whips may have distal ends electrically coupled to one another. A dielectric layer may be fastened between the first and second flexible elongate whips.

A method aspect of the present invention is directed to a method of making a portable wireless communication device, including providing wireless communication circuitry carried by a housing, and providing a flexible antenna extending outwardly from the housing and having a proximal end coupled to the wireless communication circuitry and having a distal end spaced from the proximal end. The flexible antenna may have first and second flexible elongate legs extending parallel to one another, with the first flexible elongate leg having a proximal end defining a first antenna feedpoint coupled to the wireless communication circuitry, and the second flexible elongate leg having a proximal end defining a second antenna feedpoint coupled to the portable housing. The first and second flexible elongate legs may have distal ends electrically coupled to one another.

The method may include connecting the first antenna feedpoint to the wireless communication circuitry with an antenna feed structure, and connecting the second antenna feedpoint to the portable housing with the antenna feed structure. Also, providing the flexible antenna may comprise providing the first and second flexible elongate legs as respective first and second spring steel strips. Providing the flexible antenna may comprise providing a dielectric layer between the first and second flexible elongate legs, and may also include connecting the dielectric layer and the first and second flexible elongate legs with at least one dielectric fastener.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout. The dimensions of various layers may be exaggerated for illustration purposes.

Figure 1:
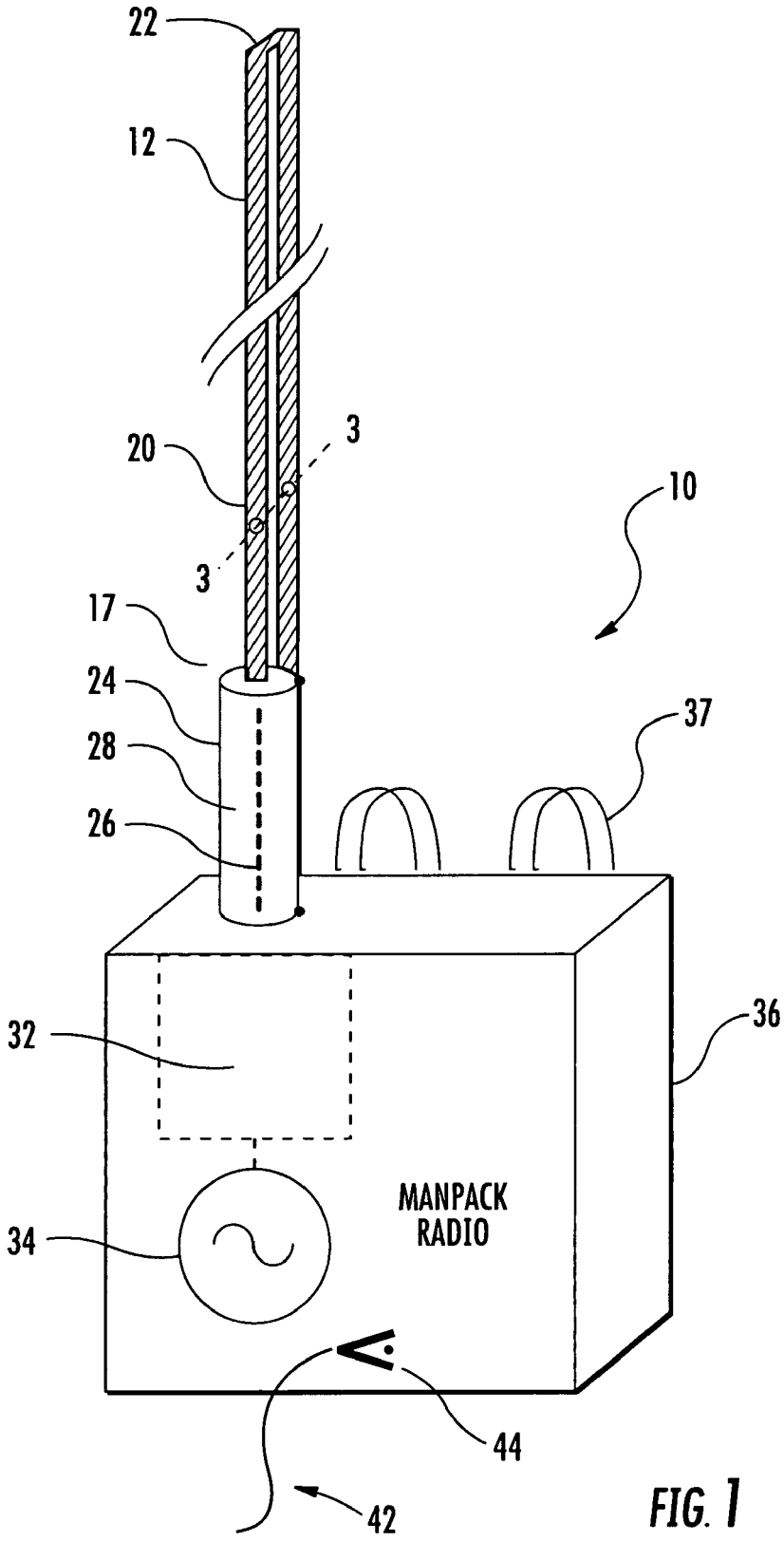
FIG. 1 is a schematic block diagram illustrating a portable wireless communication device including a folded-monopole whip antenna according to the present invention.
Figure 2:
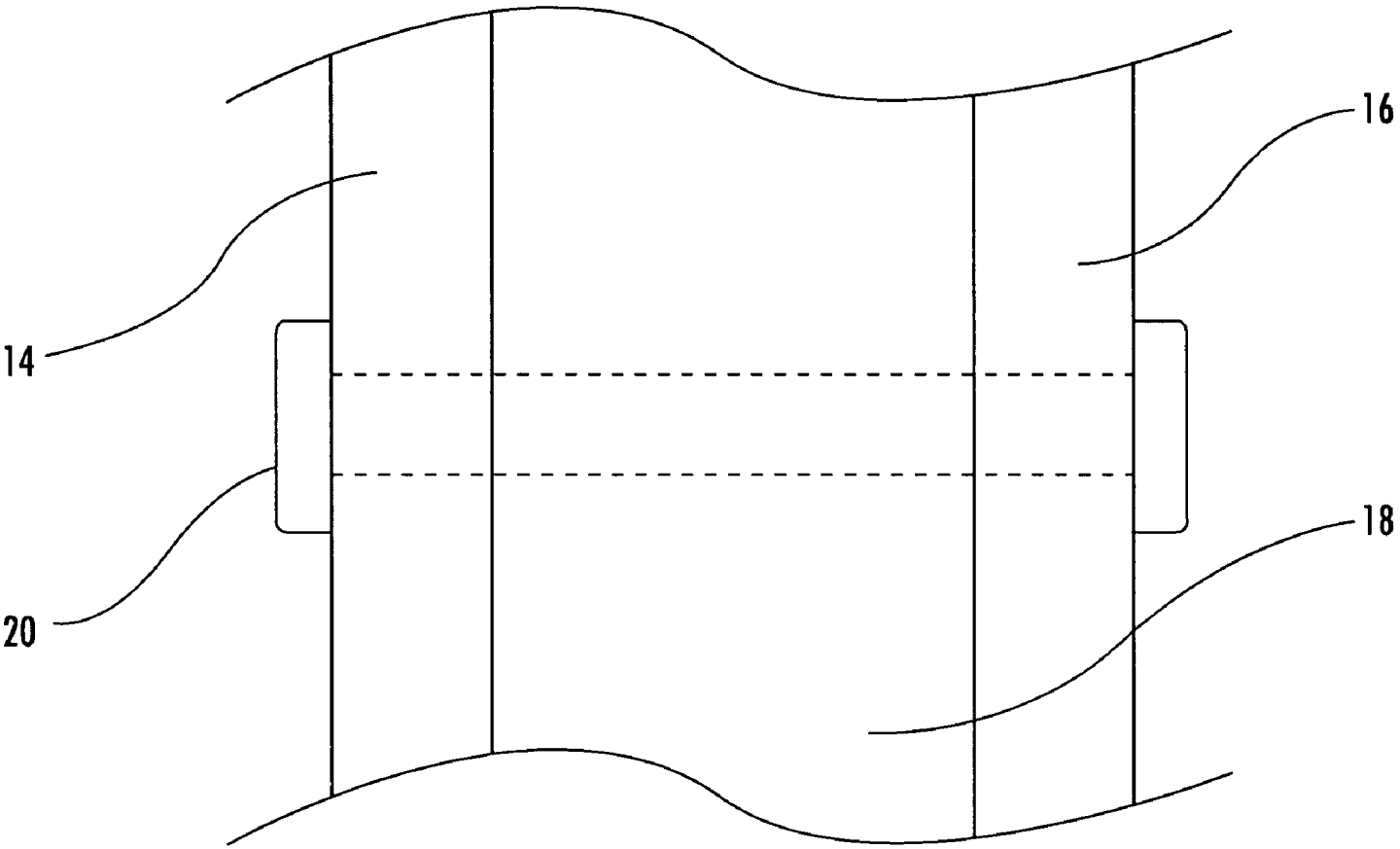
FIG. 2 is an enlarged partial side view taken along the line 3-3 of the folded-monopole whip antenna of FIG. 1.
Figure 4:
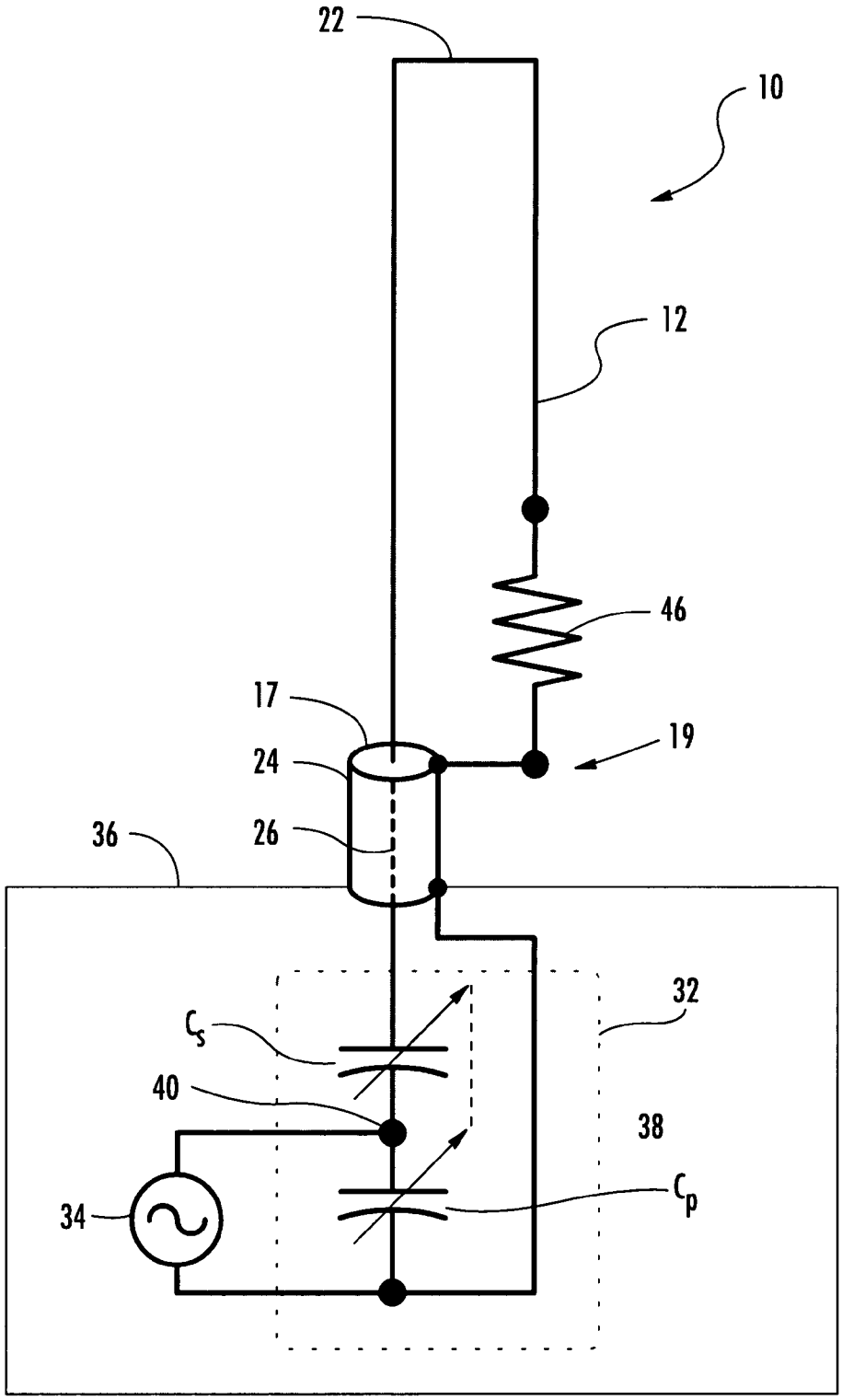
FIG. 4 is an electrical schematic diagram illustrating an example of a feeding arrangement for the folded-monopole whip antenna of FIG. 1.

Referring initially to FIGS. 1, 2 and 4, a portable wireless communication device 10 including a flexible whip antenna 12 of the folded monopole type, will now be described. The portable wireless communication device 10 includes a portable housing 36, wireless communication circuitry 34 carried by the housing, and a flexible antenna 12 extending outwardly from the housing and having a proximal end coupled to the wireless communication circuitry 34 and having a distal end spaced from the proximal end. The flexible antenna 12 may have first and second flexible elongate legs 14, 16 or strips extending parallel to one another. The flexible antenna 12 may have a length between 1/40 and 1/6 wavelengths.

The first flexible elongate leg 14 may have a proximal end defining a first antenna feedpoint 17 coupled to the wireless communication circuitry 34, and the second flexible elongate leg may have a proximal end defining a second antenna feedpoint 19 coupled to the portable housing 36. The first and second flexible elongate legs 14, 16 may have distal ends electrically coupled to one another and defining a conductive tip 22.

The portable housing 36, preferably a conductive metallic housing, may include one or more shoulder straps 37 attached thereto, as would be appreciated by those skilled in the art. An antenna matching network 32 may connect the first antenna feedpoint 17 to the wireless communication circuitry 34, and may connect the second antenna feedpoint 19 to the portable housing 36. Portable housing 36 may have a drag wire 42 electrically connected thereto by connector 44. Drag wire 42 may be a single wire or a plurality of wires.

The first and second flexible elongate legs 14, 16 may comprise respective first and second spring steel strips, which may be copper plated. The first and second steel spring strips may have a width in a range of 0.5-1.0 inches, and may have a length in a range of four to six feet, for example.

The flexible antenna may further include a dielectric layer 18 between the first and second flexible elongate legs 14, 16. Such a dielectric layer 18 may comprise a liquid crystal polymer (LCP) material and/or a polytetrafluoroethylene (PTFE) material. LCP features low permeability and moisture absorption, and high temperature strength. Furthermore, the flexible antenna 12 may further include one or more dielectric fasteners 20, e.g. rivets, connecting the dielectric layer 18 and the first and second flexible elongate legs 14, 16.

Antenna 12 may include gooseneck 24, preferably a conductive flexible gooseneck, interposed between first and second flexible elongate legs 14, 16 to allow manual orientation. A center conductor 26 conveys RF currents through gooseneck 24, forming a coaxial transmission line as is common. A dielectric 28 may be present inside gooseneck 24 and may be a liquid crystal polymer (LCP) material and/or a polytetrafluoroethylene (PTFE) foam, for example.

Figure 3A:
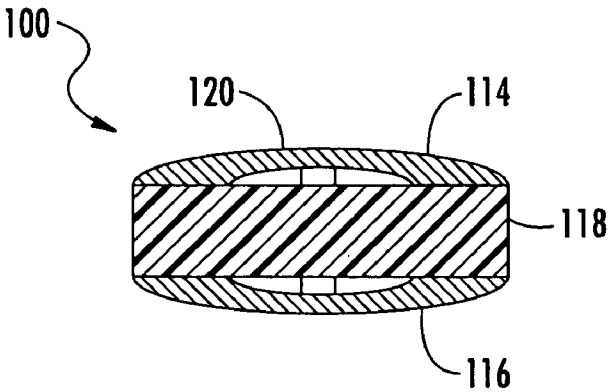
FIGS. 3A-3D are cross-sectional views illustrating various mechanical embodiments of the folded-monopole whip antenna of FIG. 1.

Referring more specifically to the cross-sectional views of the folded-monopole whip antenna 12 in FIGS. 3A-3D, various embodiments of the first and second flexible elongate legs 14, 16 will be described. Each of the first and second flexible elongate legs 14, 16 may have an arcuate cross section to urge the flexible antenna into a fully extended and straight position. In FIG. 3A, the folded-monopole whip antenna 100 includes convex first and second flexible elongate legs 114, 116 with the dielectric layer 118 therebetween, and fastened together with dielectric fastener 120. In other words, both first and second flexible elongate legs 114, 116 are curving/bulging outward.

Figure 3B:
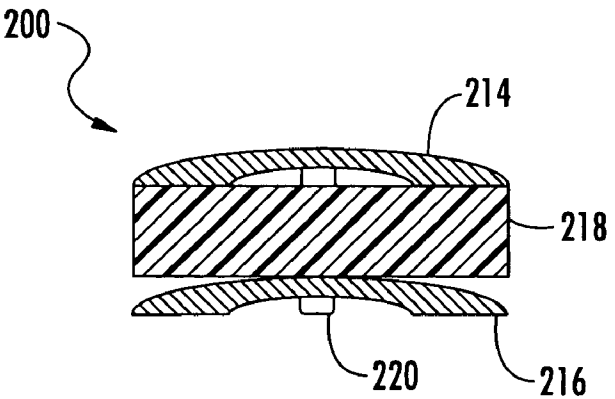
Figure 3C:
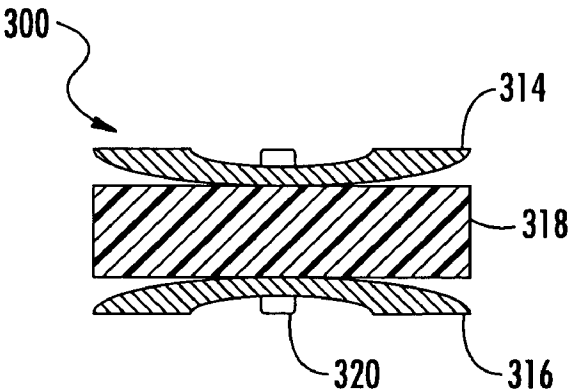
Figure 3D:
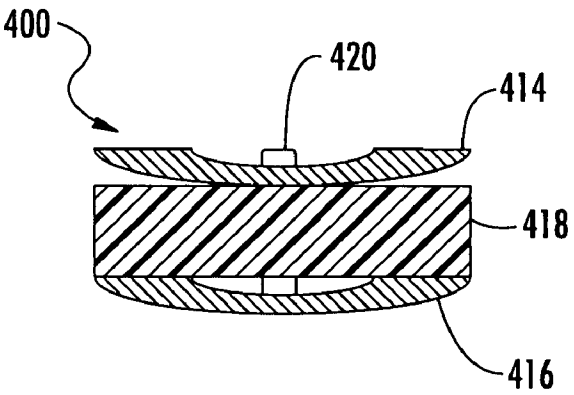

In FIG. 3B, the folded-monopole whip antenna 200 includes a convex first flexible elongate leg 214, a concave second flexible elongate leg 216, the dielectric layer 218 therebetween, and fastened together with dielectric fastener 220. In FIG. 3*c*, the folded-monopole whip antenna 300 includes concave first and second flexible elongate legs 314, 316 with the dielectric layer 318 therebetween, and fastened together with dielectric fastener 320. In other words, both first and second flexible elongate legs 314, 316 are curving/bulging inward. In FIG. 3D, the folded-monopole whip antenna 400 includes a concave first flexible elongate leg 414, and a convex second flexible elongate leg 416, the dielectric layer 418 therebetween, and fastened together with dielectric fastener 420. The various embodiments may offer varying degrees of flexibility and stiffness to urge the flexible antenna 12 into a fully extended and straight position, as may be desired.

Referring now to the FIG. 4 schematic diagram, details of a preferred electrical embodiment will now be described. Folded monopole whip antenna 12, preferably an electrically short embodiment (below natural resonance), is connected to a matching network 32. Matching network 32 preferably is a variable matching network or "antenna coupler" for broadband tunable operation. The matching network may contain two matching capacitors $C_s$, $C_p$ connected in a string between folded monopole whip antenna 12 and portable housing 36. Wireless communication circuitry 34 connects to node 40 between $C_s$ and $C_p$. Folded monopole antenna 12 may be considered both an antenna and a transmission line stub inductor in parallel.

Continuing to refer to FIG. 4, the total series capacitance $C_t$ of the $C_s$, $C_p$ combination ($C_t=1/((1/C_s)+(1/C_p))$) adjusts the operating frequency of folded monopole antenna 12, and the ratio of $C_s$ to $C_p$ sets the resistance obtained at node 40. Series matching capacitors $C_s$, $C_p$ may be rotary and of the differential or butterfly type to eliminate sliding contacts. When $C_s$, $C_p$ are ganged together, single control tuning is possible, as the ratio of $C_s$ to $C_p$ can be constant for several octaves of bandwidth when the antenna is electrically small. This is because the radiation resistance and conductor loss resistance are approximately inverse to each other. In high speed tuning embodiments of matching network 32, discrete values of $C_s$, $C_p$ may be switched in from a capacitor bank, e.g. by PIN diodes or relays.

Figure 5:
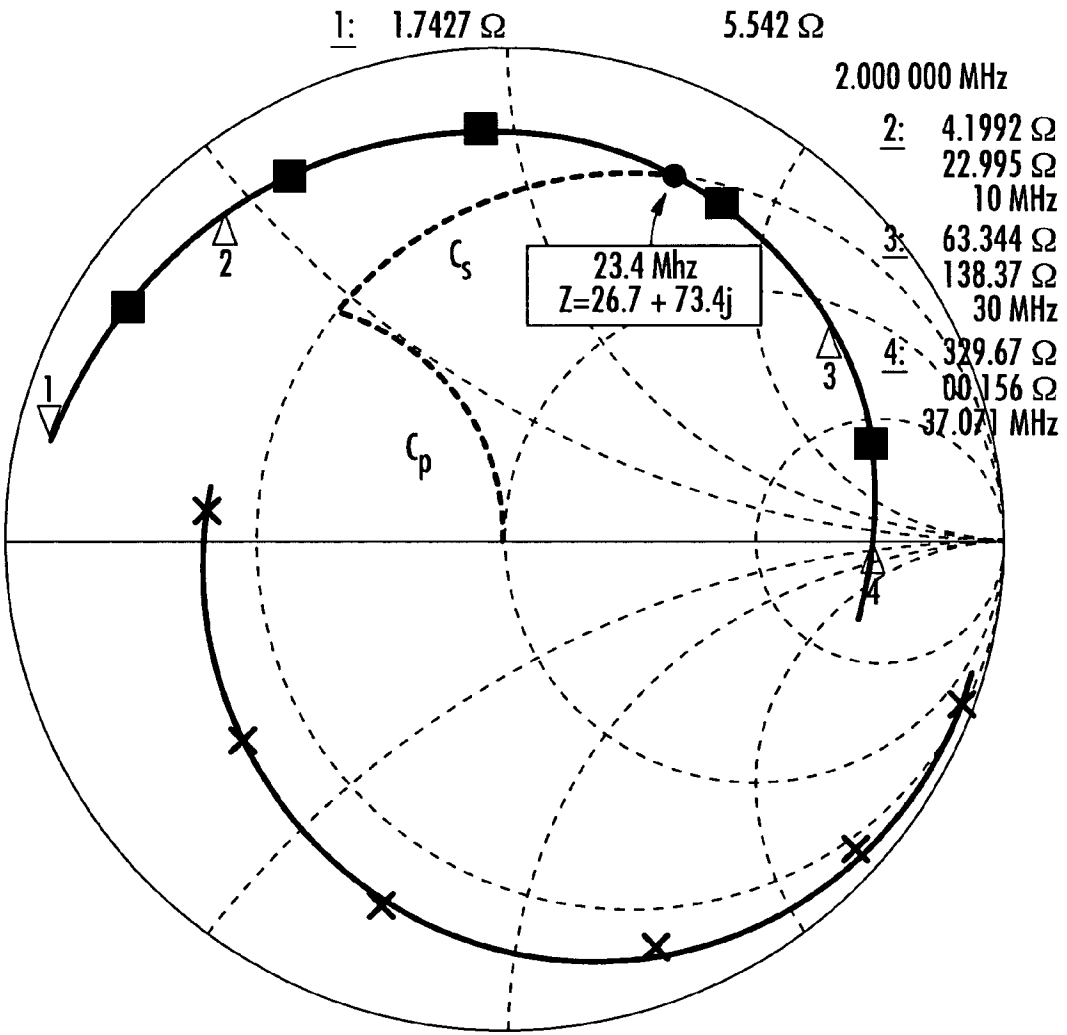
FIG. 5 is vector impedance diagram (Smith Chart) based upon measurements from a prototype of the folded-monopole whip antenna of FIG. 1. The diagram is normalized to 50 ohms.

FIG. 5 plots the driving point impedance measured from a 54 inch tall physical prototype of the FIG. 1 folded monopole whip antenna 12, on vector impedance paper (Smith Chart). The present invention curve is marked with squares and the X marked curve may be typical of prior art (unfolded) whips. An example matching approach (FIG. 4 network) is drawn for 23.4 Mhz. In the example approach, $C_s$ had a value of 141 pf and $C_p$ a value of 131 pf. As can be appreciated from FIG. 5, network 32 can provide a 50 ohm resistive match.

The present invention is not so limited however, as to require the FIG. 4 embodiment of matching network 32. Matching network 32 could also use, e.g. a series capacitor and a transformer. Capacitors are preferential matching components and their losses are often negligible in the present invention. In some instances, the predominant loss mechanism is proximity effect i.e., radial electric near field interaction with personnel and soils, due to both their water content, as water is a polar molecule of high permittivity and loss tangent. Personnel in fact have properties approaching that of seawater, having a dielectric constant ($\in_r$) of about 50 farads/meter and conductivity ($\sigma$) of 1.0 mhos/meter, while seawater is typically $\in_r=81$ and conductivity $\sigma=5.0$.

Folded-monopole whip antenna 12 may have an apex loading resistor 46 connected between the second flexible elongate leg 16 and portable housing 36 for broadband matching, i.e. increased instantaneous VSWR bandwidth. As can be appreciated by those familiar with the art, apex loading resistor offers a trade between radiation efficiency and instantaneous VSWR bandwidth, such as to meet military instantaneous bandwidth requirements associated with frequency hopping, automatic link establishment, or jamming. Operational requirements may favor apex loading resistor 46 for VHF use and omit it at HF. When apex loading resistor 46 is of large value, matching network 32 can be a transformer alone. The value of apex loading resistor 46 may range from about 100 to 400 ohms, depending on VSWR requirements. Antenna folding transforms the apex loading resistance to a lower value at the driving point With first and second flexible elongate legs 14, 16 identical (equal width folded conductors), apex load resistor is referred to the driving point at 4 to 1 reduction ratio near resonance. The invention is of course not so limited however as to require any specific value for apex loading resistor 46.

Figure 6:
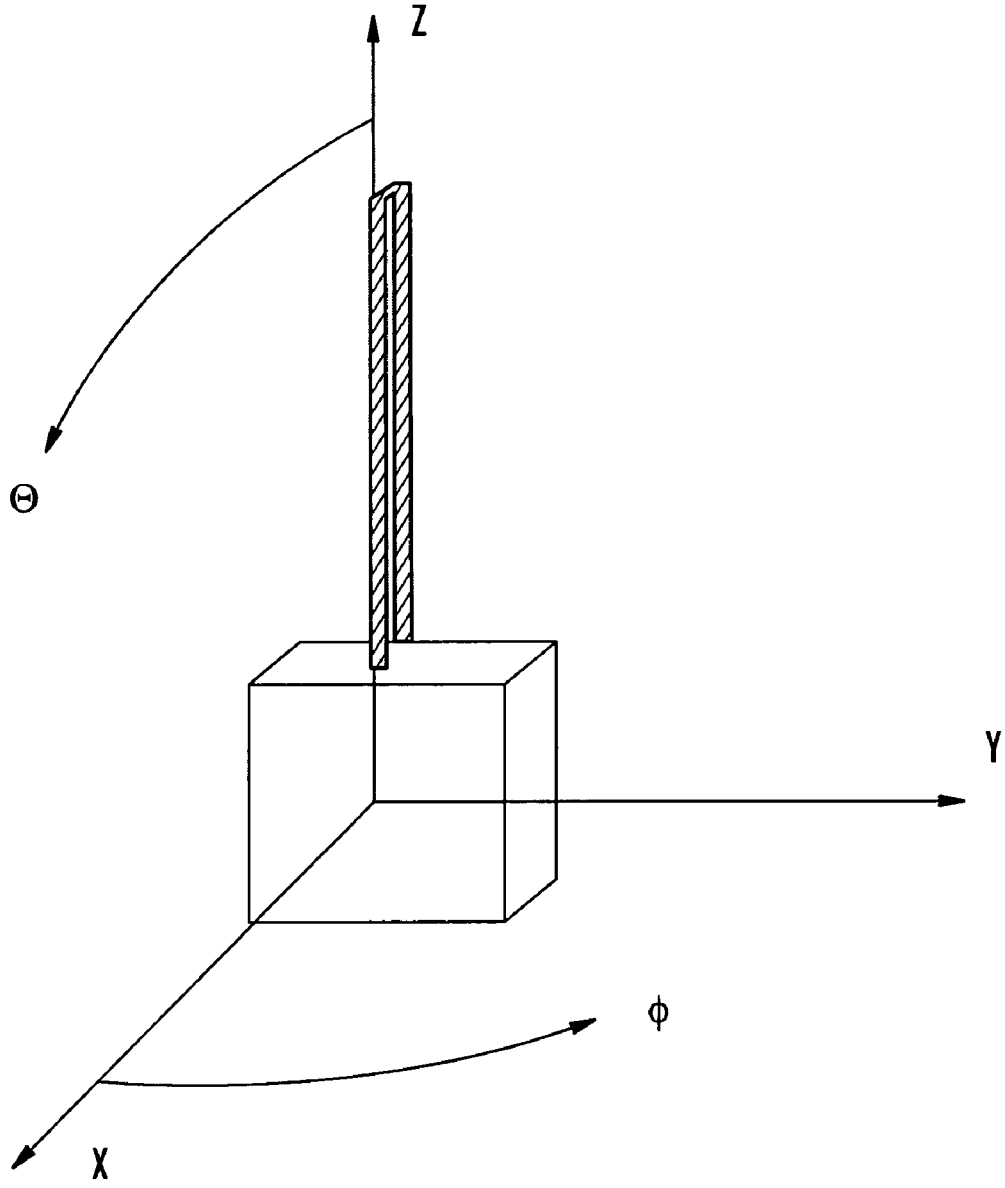
FIG. 6 is a schematic diagram showing the folded monopole whip antenna of the present invention in a standard radiation pattern coordinate system.
Figure 7A:
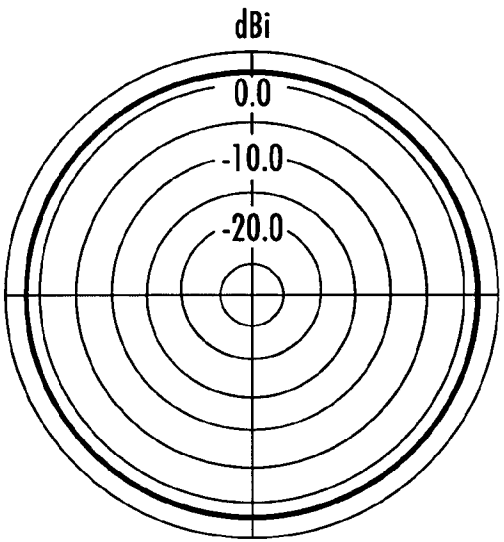
FIGS. 7A-7C are graphs depicting the principal plane radiation patterns of the folded monopole whip antenna of FIG. 1 in free space.
Figure 7B:
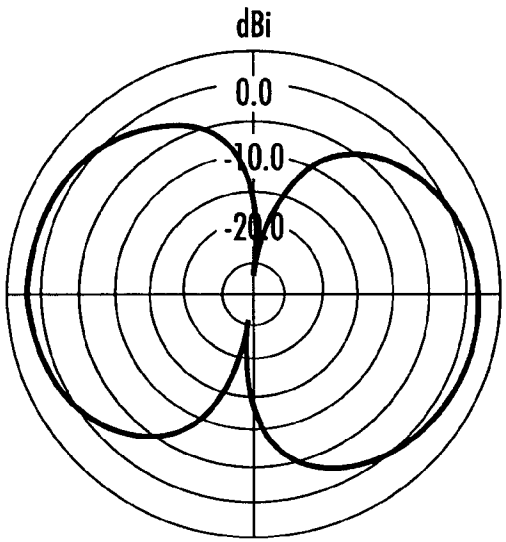
Figure 7C:
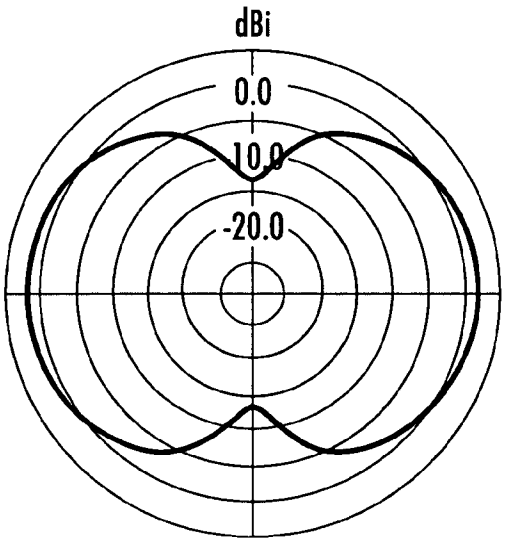

FIG. 6 shows the present invention in a standard radiation pattern coordinate system. The free space radiation patterns FIGS. 7A-7C correspond to the XY, YZ and ZX plane cuts at 30 Mhz. As can be appreciated, the radiation patterns are similar in shape to conventional military whip antennas and to the two petal rose of small dipoles: $\sin^2 \theta$ shape in elevation and circular in azimuth.

Figure 8:
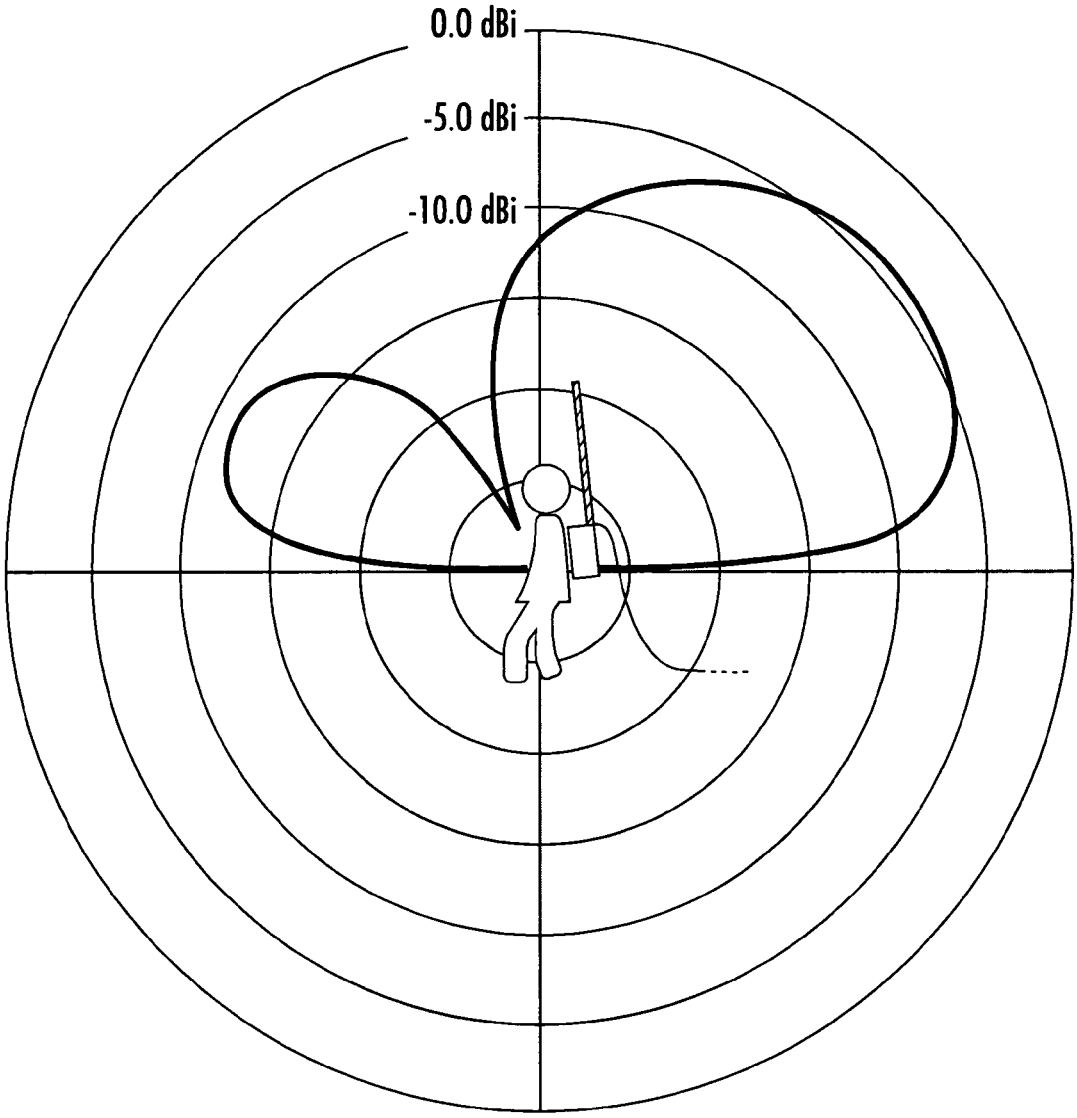
FIG. 8 is a graph illustrating an example elevation plane radiation pattern of the folded-monopole whip antenna of FIG. 1, including proximity effects.

The FIG. 8 example radiation pattern is an elevation cut at 7.0 Mhz, including a 27 foot drag wire and the proximity effects of soil and the radio operator. It was calculated from a virtual model in the Lawrence Livermore NEC4.1 method of moments code, as it is somewhat impractical to physically measure elevation patterns of low frequency antennas near soil. The Sommerfeld/Asymptotic ground computation was used to incorporate the effects of reactive near fields.

A method aspect of the present invention is directed to a method of making a portable wireless communication device 10, including providing wireless communication circuitry 34 carried by a housing 36, and providing a flexible antenna 12 extending outwardly from the housing and having a proximal end coupled to the wireless communication circuitry and having a distal end spaced from the proximal end. The flexible antenna 12 may have first and second flexible elongate legs 14, 16 extending parallel to one another, with the first flexible elongate leg 14 having a proximal end defining a first antenna feedpoint 17 coupled to the wireless communication circuitry 34, and the second flexible elongate leg 16 having a proximal end defining a second antenna feedpoint 19 coupled to the portable housing 36. The first and second flexible elongate legs 14, 16 may have distal ends electrically coupled to one another at the conductive tip 22.

The method may include connecting the first antenna feedpoint 17 to the wireless communication circuitry 34 with an antenna matching network 32, and connecting the second antenna feedpoint 19 to the portable housing 36 with the antenna matching network 32. Also, providing the flexible antenna 12 may comprise providing the first and second flexible elongate legs 14, 16 as respective first and second spring steel strips. Providing the flexible antenna 12 may comprise providing a dielectric layer 18 between the first and second flexible elongate legs 14, 16, and may also include connecting the dielectric layer 18 and the first and second flexible elongate legs with at least one dielectric fastener 20.

Natural resonance in the present invention occurs for whip lengths of about ⅙ wavelengths. Conventional, unfolded whips are naturally resonant near ¼ wavelengths. Thus, the present invention may offer an antenna approach about 30% shorter than unfolded prior art, especially when a matching network is not used. The manpack radio—whip combination is a complex structure electrically akin to an asymmetric dipole and exact resonant whip lengths vary with radio size.

The present invention may be expanded to include multiple folds, such as 3 or more elongate legs. Multiple folds have the effect of further increasing driving point resistance. A discussion of this may be found in the text "Antennas", John Kraus, $2^{nd}$ Edition, pp 511-513, which is incorporated herein by reference.

For VHF use, it is beneficial to make gooseneck 24 about 20 inches high, such that the feedpoint of the antenna structure as a whole is elevated above the operators head. Gooseneck 24 then acts as inset feed to the antenna structure overall, elevating the region of maximum current distribution. Antenna currents flow over the outside of the gooseneck independently of the transmission line mode currents on the inside due to RF skin effect, forming an inset feed. The antenna currents are thus common mode currents on the outside only of the gooseneck. The 20 inch elevation of the antenna feedpoint has been founds to reduce proximity effect impedance variations as well as to enhance radiation efficiency and gain. Another benefit of elevating the feedpoint is to reduce RF currents on the radio chassis for human safety at high power levels.

For HF use, Gooseneck 24 may however be of shorter lengths as the RF current distribution on the antenna and radio become more uniform. This is also beneficial at HF for VSWR considerations.

For portable communications at HF, the drag wire 42 may be a single wire about ⅕ to ¼ wavelength long pulled along the ground by the radio operator. The single wire may be Teflon insulated, of the stranded conductor type, and the associated connector 44 may be an alligator clip. Drag wire 42 in effect forms a dipole half element to antenna 12.

The overall antenna system includes, electrically, the radio chassis, the gooseneck, and the folded monopole, forming a dipole type antenna. At HF and low VHF most radio chassis are not large enough to approximate a true image plane. Thus, the term monopole has been used for convenience in the descriptions, and it is understood that a partially folded asymmetric dipole is actually formed from the overall structure. It is perhaps common to categorize antenna systems relative to cannon antennas (dipole, loop, etc.). The present invention is a hybrid of several canonical types: the dipole, folded dipole and monopole. It takes advantage of the benefits of each.

Thus, leaf springs or whips form the folded-monopole whip antenna 12, and the radiating element is a folded monopole antenna of balanced microstrip transmission line. Common and differential mode currents cause and impedance conversion and radiation respectively. Antenna 12 is self resonant in shorter length than a typical military whip antenna while having increased gain and greater range. When loaded to resonance, it provides greater gain by replacing the lossy loading inductor with an efficient loading capacitor.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A portable wireless communication device comprising:

a portable housing;

wireless communication circuitry carried by said housing;

a flexible antenna extending outwardly from said housing and having a proximal end coupled to said wireless communication circuitry and having a distal end spaced from said proximal end;

said flexible antenna having first and second flexible elongate legs extending parallel to one another, said first flexible elongate leg having a proximal end defining a first antenna feedpoint coupled to said wireless communication circuitry, said second flexible elongate leg having a proximal end defining a second antenna feedpoint coupled to said portable housing, said first and second flexible elongate legs having distal ends electrically coupled to one another; and an antenna feed structure connecting the first antenna feedpoint to said wireless communication circuitry, and connecting the second antenna feedpoint to said portable housing.

2. The portable wireless communication device according to claim 1, wherein said first and second flexible elongate legs comprise respective first and second spring steel strips.

3. The portable wireless communication device according to claim 2, wherein said first and second spring steel strips are copper plated.

4. The portable wireless communication device according to claim 1, wherein said flexible antenna further comprises a dielectric layer between said first and second flexible elongate legs.

5. The portable wireless communication device according to claim 4, wherein said dielectric layer comprises at least one of a liquid crystal polymer (LCP) material and polytetrafluoroethylene (PTFE) material.

6. The portable wireless communication device according to claim 4, wherein said flexible antenna further comprises at least one dielectric fastener connecting said dielectric layer and said first and second flexible elongate legs.

7. The portable wireless communication device according to claim 1, wherein each of said first and second flexible elongate legs has an arcuate cross section to urge said flexible antenna into a fully extended and straight position.

8. A folded-monopole whip antenna for a portable wireless communication device having a portable housing and wireless communication circuitry carried thereby, the antenna comprising:

a flexible antenna element extending outwardly from said housing and having a proximal end for coupling to the wireless communication circuitry and having a distal end spaced from said proximal end;

said flexible antenna element having first and second flexible elongate legs extending parallel to one another, said first flexible elongate leg having a proximal end defining a first antenna feedpoint to be coupled to the wireless communication circuitry, said second flexible elongate leg having a proximal end defining a second antenna feedpoint to be coupled to the portable housing, said first and second flexible elongate legs having distal ends electrically coupled to one another; and said flexible antenna element including a dielectric layer fastened between said first and second flexible elongate legs.

9. The folded-monopole whip antenna according to claim 8, wherein said first and second flexible elongate legs comprise respective first and second spring steel strips.

10. The folded-monopole whip antenna according to claim 9, wherein said first and second spring steel strips are copper plated.

11. The folded-monopole whip antenna according to claim 8, wherein said dielectric layer comprises at least one of a liquid crystal polymer (LCP) material and polytetrafluoroethylene (PTFE) material.

12. The folded-monopole whip antenna according to claim 8, wherein said flexible antenna element further comprises at least one dielectric fastener extending through said dielectric layer and said first and second flexible elongate legs.

13. The folded-monopole whip antenna according to claim 8, wherein each of said first and second flexible elongate legs has an arcuate cross section to urge said flexible antenna element into a fully extended and straight position.

14. A portable wireless communication device comprising:

a portable housing;

wireless communication circuitry carried by said housing;

a flexible antenna extending outwardly from said housing and having a proximal end coupled to said wireless communication circuitry and having a distal end spaced from said proximal end;

said flexible antenna having first and second flexible elongate legs extending parallel to one another, said first flexible elongate leg having a proximal end defining a first antenna feedpoint coupled to said wireless communication circuitry, said second flexible elongate leg having a proximal end defining a second antenna feedpoint coupled to said portable housing, said first and second flexible elongate legs having distal ends electrically coupled to one another; each of said first and second flexible elongate legs having an arcuate cross section to urge said flexible antenna into a fully extended and straight position.

15. The portable wireless communication device according to claim 14, wherein said first and second flexible elongate legs comprise respective first and second spring steel strips.

16. The portable wireless communication device according to claim 15, wherein said first and second spring steel strips are copper plated.

17. The portable wireless communication device according to claim 15, wherein said flexible antenna further comprises a dielectric layer between said first and second flexible elongate legs.

18. The portable wireless communication device according to claim 17, wherein said dielectric layer comprises at least one of a liquid crystal polymer (LCP) material and polytetrafluoroethylene (PTFE) material.

19. The portable wireless communication device according to claim 17, wherein said flexible antenna further comprises at least one dielectric fastener connecting said dielectric layer and said first and second flexible elongate legs.

* * * * *